United States Patent [19]

Theurer

[11] 4,130,062

[45] Dec. 19, 1978

[54] APPARATUS FOR OBTAINING A CONTROLLED DEGREE OF BALLAST COMPACTION IN THE TAMPING AND LEVELING OF A TRACK

[75] Inventor: Josef Theurer, Vienna, Austria

[73] Assignee: Franz Plasser Bahnbaumaschinen-Industriegesellschaft m.b.H., Vienna, Austria

[21] Appl. No.: 675,944

[22] Filed: Apr. 12, 1976

Related U.S. Application Data

[63] Continuation-in-part of Ser. No. 556,177, Mar. 6, 1975, which is a continuation of Ser. No. 438,264, Jan. 31, 1974, Pat. No. 3,910,195.

[30] Foreign Application Priority Data

Apr. 26, 1973 [AT] Austria ..... 3742/73

[51] Int. Cl.[2] ..... E01B 27/16

[52] U.S. Cl. ..... 104/7 R

[58] Field of Search ..... 104/7 R, 7 B, 12

[56] References Cited

U.S. PATENT DOCUMENTS

| | | | |
|---|---|---|---|
| 3,119,346 | 1/1964 | Derler | 104/12 |
| 3,795,198 | 3/1974 | Plasser et al. | 104/12 |

*Primary Examiner*—Richard A. Bertsch

*Attorney, Agent, or Firm*—Kurt Kelman

[57] ABSTRACT

A controlled degree of ballast compaction is obtained with a mobile track tamping and leveling machine which comprises a track holding device holding the track at a leveled position under the control of an error signal from a reference system. The track is raised and ballast is compacted under the points of intersection between the track rails and ties, the ballast being pressed against the held track until it has reached a controlled degree of compaction. Jacking of the track is terminated before tamping.

4 Claims, 5 Drawing Figures

APPARATUS FOR OBTAINING A CONTROLLED DEGREE OF BALLAST COMPACTION IN THE TAMPING AND LEVELING OF A TRACK

This is a continuation-in-part of my U.S. Pat. application Ser. No. 556,177, filed Mar. 6, 1975, which is a continuation of my application Ser. No. 438,264, filed Jan. 31, 1974, now U.S. Pat. No. 3,910,195.

The present invention relates to improvements in track surfacing operations, and more particularly in the tamping and leveling of a track consisting of rails mounted on ties having two elongated edges extending transversely of the rails and two ends extending in the direction of the rails, the rails and ties intersecting at points spaced in the direction of elongation of the track and the ties resting on ballast. The elongated edges of adjacent ones of the ties define cribs therebetween, and the track is leveled or graded in relation to a reference system.

In known track leveling methods, the ballast is compacted under the ties, and more particularly under the points of intersection, by vibratory pressure exerted upon the ballast under the ties inwardly from the two longitudinal tie edges whereby the progressively more compacted ballast raises the track, the track being independently lifted before and/or during the ballast tamping, if desired, until it has reached the leveled position determined by a reference system including a pickup and transmitter of an error signal for leveing the track in response to the error signal. While such track surfacing has been found quite useful, the desired degree of ballast compaction under the ties has not always been achieved.

It has also been proposed to provide mobile track tamping machines with a tamping tool assembly vertically movably mounted on a machine frame for tamping a respective one of the ties, such an assembly comprising a pair of opposed vibratory tamping tools arranged for immersion in the cribs adjacent the tie and for reciprocation in the direction of track elongation, with the tie positioned between the opposed tools, and an additional vibratory tamping tool arranged for immersion in the ballast adjacent the end of the tie and for reciprocation in a direction transverse to the direction of track elongation. With such an arrangement, the ballast is "boxed in" between the tamping tools substantially from the point of intersection of the rail and tie to the end of the tie, thus preventing the outward displacement of ballast during the tamping operation. However, no control over the leveling of the track or the degree of ballast compaction is possible with such known track tampers because they neither comprise a leveling reference nor a tamping control.

It is also known to level track solely by tamping the ballast under the ties. In such track leveling machines, only opposed tamping tools reciprocated in the direction of track elongation are used and a control terminates the tamping operation in response to a reference signal indicating the desired track level. If the track must be raised to the desired level through a considerable lifting stroke, such machines also use independent track lifting mechanisms. However, controlled uniform ballast compaction cannot be achieved with such machines since the ballast may escape laterally when the tamping pressure in the direction of track elongation exceeds a given degree while, in other track sections, the desired track level has been reached before the ballast has been sufficiently compacted.

Furthermore, it has been proposed to assure the maintenance of a desired track level even under high tamping pressures by holding the track in position during tamping, the track holding being so controlled that the track will not be raised beyond the desired level during tamping. This prevents uncontrolled raising of the track but it does not assure the termination of the tamping when a desired degree of ballast compaction has been reached.

Thus, conventional track surfacing methods and apparatus have not been able to assure a desired, preferably uniform and optimal maximum, degree of ballast compaction under each tie over a long track section. It is, therefore, the primary object of this invention to obtain such ballast compaction, which is particularly important in track sections designed for high-speed trains.

This and other objects are accomplished by the invention in a method of leveling a track in relation to a reference system by holding the track in the leveled position under the control of the reference system in the region of tamping, the ballast being pressed against the held track until it has reached a controlled degree of compaction. The track is jacked up towards the leveled position and track jacking is terminated tenths of seconds up to several seconds before track tamping has been completed, the ballast being compacted under the points of intersection of the ties and rails by vibratory pressure exerted upon the ballast under the ties inwardly from the two longitudinal tie edges and preferably from the tie ends. This produces not only a high degree of accuracy in the track level but also an optimally and uniformly compacted ballast bed.

Since tamping proceeds always simultaneously with jacking, track surfacing according to the present invention does not disturb the position of those ballast pieces whose sharp edges or corners bite into the underside of wooden ties when the track settles on the ballast bed, thus leaving the ballast enmeshed with the ties. This is of particular advantage in high-speed traffic sections where the passing trains have strongly settled the track, the method of this invention providing for the track to be lifted during leveling with the conventional track lifting mechanism without destroying the intermeshing relationship of the ties and ballast. Tamping while jacking according to the invention, the ballast pieces remain undisturbed in their relationship to the undersides of the ties and are even pressed further into the undersides when the tamped ballast presses upwardly against the held track after jacking has ceased. This also assures a particularly sensitive approach of the track to the leveled position since the track is not torn out of its settled position but progressively pressed from the settled into the leveled position, which improves the accuracy of the leveling operation.

A mobile track tamping and leveling machine according to the present invention combines a known type of a leveling reference system and of a tamping tool assembly which comprises not only a pair of opposed vibratory tamping tools but preferably also an additional vibratory tamping tool adjacent the tie end with a track holding device holding the track at the leveled position controlled by the error signal from the reference system. Furthermore, a control regulates the track jacking and the drive means for the reciprocation and for the vibration of the tamping tools so that jacking and tamping initially proceed simultaneously but jacking is terminated before tamping has been completed.

With this combination of structures mounted on the mobile machine frame, the track will be leveled automatically and the ballast tamping will be terminated automatically when the optimal ballast compaction has been reached, the machine being readily adaptable by the control to differing ballast conditions while assuring long-lasting ballast compaction.

The above and other objects, advantages and features of the present invention will become more apparent from the following detailed description of certain now preferred embodiments thereof, taken in conjunction with the accompanying drawing wherein FIG. 1 is a schematic side elevational view of a ballast tamping and track leveling machine with a simple control system according to this invention;

Figure 1:
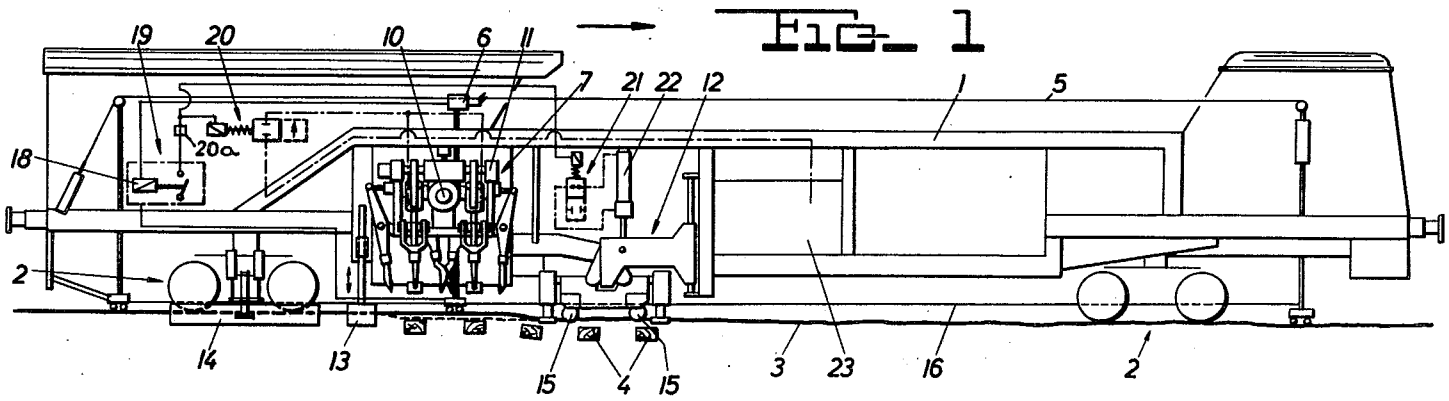
Figure 2:
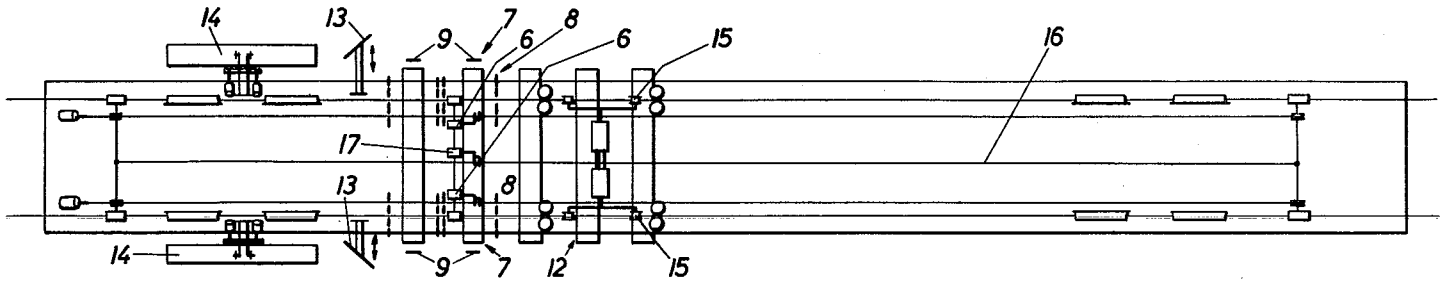
FIG. 2 is a top plan view of FIG. 1.

Referring now to the drawing and first to FIGS. 1 and 2, there is shown a mobile track tamper and liner whose elongated frame 1 is supported on undercarriages 2, 2 spaced apart to provide a long wheel base and running on a track constituted by rails 3 and ties 4 in a working direction indicated by a horizontal arrow, the track ties resting on ballast (not shown). The tamping and leveling machine includes a first reference system including tensioned wire 5 extending from an end point in an uncorrected track section to an end point in the corrected track section. The end points of the reference wire are anchored to bogies running on the track and are vertically movable independently of machine frame 1. To measure the level of the track relative to reference wire 5, a level signal pickup and transmitter 6, such as a rotary coil or potentiometer, cooperates with the wire. All of these structures and their operation are well known in track surfacing operations and, therefore, require no further description herein.

Figure 3:
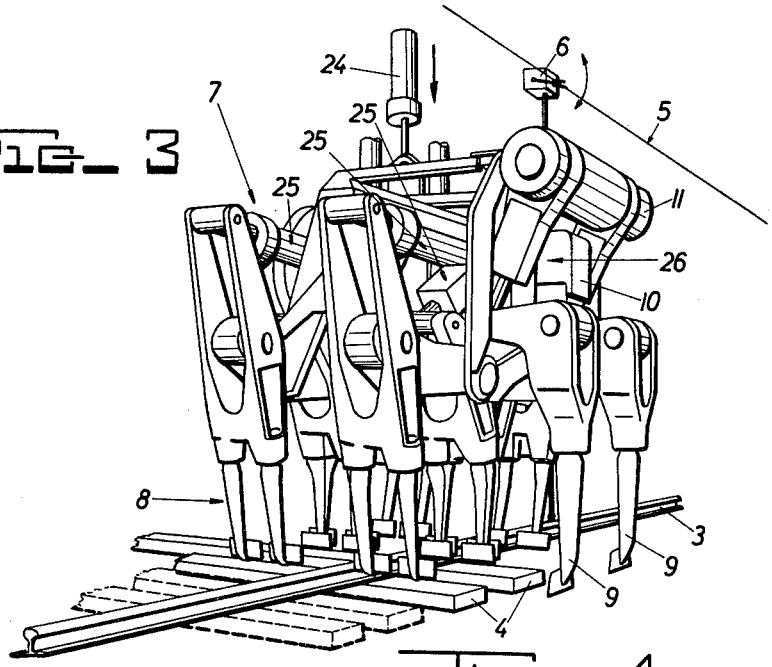
FIG. 3 is an enlarged perspective view of a tamping tool assembly with crib and end tamping tools arranged for the simultaneous tamping of two adjacent ties.

The tamping tool assembly or unit 7 illustrated more particularly in FIG. 3 is arranged for simultaneously tamping two adjacent ties 4, the assembly being mounted on machine frame 1 for vertical movement by means of hydraulic jack 24 so that the tamping tools may be moved from an inoperative position into an operative or tamping position wherein the jaws on the lower ends of the tamping tools are immersed in the ballast underneath the ties. The tamping tool assembly comprises two pairs of opposed vibratory tamping tools 8, which are termed "crib" tamping tools herein, which pairs of tools are so spaced from each other in the direction of elongation of the track that the tools of each pair which are adjacent to each other are at a smaller distance from each other than the distance between adjacent ones of the ties so that the two adjacent tamping tools enter into the same crib when the assembly is lowered. The opposed vibratory tamping tools 8 of each pair are arranged for immersion in the cribs adjacent one of the ties and for reciprocation in the direction of track elongation, with the one tie positioned between the opposed tools of each pair. Such a tamping tool assembly is described and claimed, for instance, in U.S. Pat. Nos. 3,357,366, dated Dec. 12, 1967 and No. 3,372,651, dated Mar. 12, 1968.

The tamping tool assembly also includes additional vibratory tamping tools 9 which are termed "end" tamping tools herein, which are arranged for immersion in the ballast adjacent the ends of ties 4 and for reciprocation in a direction transverse to the direction of track elongation, i.e. towards the ends of the ties in the longitudinal direction thereof. Drive 10, which may include a rotary cam shaft, is operatively connected to tamping tools 8 for imparting vibration thereto and drive 11, which may also include a rotary cam shaft, is operatively connected to tamping tools 9 for imparting vibration thereto. Power means are also provided to reciprocate the tamping tools in a manner well known per se, such means including hydraulic cylinders, if desired, or rotary threaded spindles. Nonsynchronous reciprocation of the crib tamping tools, such as shown in U.S. Pat. No. 3,357,366, for instance, will be preferred.

As shown in FIG. 1, the machine frame also carries a track lifting and leveling unit 12 which may be of any suitable design, the illustrated unit including pairs of flanged rail-gripping rollers 15, 15 engaging each rail and mounted on a vertically movable carrier bracket which also carries hydraulic shoes supported on the ballast.

Ballast plows 13, 13 are arranged on the frame rearwardly of the tamping tool assembly, as seen in the working direction, the plows being mounted laterally adjacent the track and being vertically and transversely adjustable to enable ballast to be moved from the shoulder of the ballast bed to the region immediately adjacent the ends of the ties. This makes it possible for the surface tampers 14, which are mounted on frame 1 in the region of the rear wheels 2 of the machine, properly to consolidate or compact the ballast at the tie ends.

As is also well known per se, lining of the track by means of unit 12 is effected in respect of a second reference system 16 which cooperates with measuring signal pickup and transmitter 17 (see FIG. 2) associated with the control for the hydraulic drives of the unit.

The above described mobile track tamping and leveling machine operates as follows:

As the machine advances intermittently from working station to working station to level and tamp the track at each station, hydraulic fluid is supplied to jack 24 to lower tamping tool assembly 7 into its working position wherein the crib and end tamping tools 8 and 9 are immersed in the ballast at the beginning of each operation and then to lift assembly 7 after completion of the operation to enable the machine to advance to the next station. When the measuring signal pickup and transmitter 6 is aligned with an uneven or uncorrected track section (indicated by broken lines in FIG. 1), the resultant error signal is transmitted therefrom to relay 18 of control device 19 to close a switch in the control circuit. This actuates solenoid valves 20 and 21 arranged in the control circuit and opens valves 20 and 21 mounted in the hydraulic fluid supply lines leading from fluid supply tank 23 to the reciprocating drives for the tamping tools and to lifting cylinder 22, respectively, to permit hydraulic fluid to flow to the tamping tool drives and cylinder. The lifting cylinder is operatively connected to the carrier bracket of lifting and lining unit 12 for raising the track. When control device 19 is no longer triggered by an error signal, i.e. lifting unit 12 has raised the track to a desired level, valve 21 is closed and further flow of hydraulic fluid between cylinder 22 and tank 23 is stopped. In this manner, jack 22 becomes a locking device holding unit 12 in its vertical position so that unit 12 becomes a track holding device.

Time-delay circuit 20a is arranged in the control circuit line leading from control device 19 to valve 20, this circuit being set to produce a delay anywhere from a few tenths of a second to several seconds in transmitting an actuating impulse to valve 20 after the control device opens and closes the switch in the valve control circuit. Thus, within the set time delay after valve 21 has been opened to raise the track, valve 20 opens to permit the flow of hydraulic fluid from tank 23 to the hydraulic drives for reciprocating the tamping tools whereby the ballast is squeezed between the tools underneath the ties, pairs of crib tamping tools being mounted around the points of intersection between ties 4 and rails 3, as shown in FIG. 3, to assure particularly effective ballast tamping at these supports points of the track. The supply of hydraulic fluid to the reciprocating drives, i.e. reciprocation of the tamping tools and further compaction of the ballast underneath the ties, is terminated after the track has been locked at the desired level by unit 12 at the level indicated in full lines in FIG. 1, with the time delay provided by device 20a. The tamping after termination of jacking will increase the ballast compaction under the ties. The end tamping tools will prevent any ballast from being outwardly displaced towards the shoulder of the bed even when the compacting pressure of crib tamping tools 8 is quite high. This makes it possible to obtain a maximum compaction of the ballast for very firm and long lasting support of a leveled track even where the original condition of the bed varies considerably.

Alternatively to the provision of a time delay for operation of valve 20 in a common control circuit for valves 20 and 21, it would be possible simply to provide an independent control circuit for the reciprocation of tamping tools 8 and 9 so that the same continues until the desired degree of ballast compaction has been obtained, while unit 12 is in its locked position at one side of the leveled track section and rear undercarriage 2 will transmit at least half the weight of the heavy machine to the track at the other side of the leveled track section. Thus, though same will be held down in the leveled position determined by reference system 5 while such additional tamping proceeds.

FIG. 3 shows the tamping tool assembly in greater detail, one such assembly being associated with each rail 3. Each tamping tool assembly 7 is glidably supported on vertical posts on frame 1 and is vertically movable by hydraulic cylinder or jack 24 for tamping two adjacent ties 4 (shown in full lines). In the working position, the crib tamping tools 8 are immersed in the ballast alongside the longitudinal sides of the track ties while end tamping tools 9 are immersed in the ballast alongside the ends of the ties, thus effectively "boxing in" the ballast therebetween and, most particularly, under the points of intersection between the ties and the rails. Drive 10 vibrates tamping tools 9 and drive 11 vibrates tamping tools 8 so that they are vibrated in vertical planes substantially transverse and parallel to the track.

Hydraulic reciprocating drives 25 squeeze the tamping tools 8 of each pair together and move them apart while hydraulic reciprocating drives 26 move end tamping tools 9 towards and away from the tie ends, the well known non-synchronous tamping tool reciprocating drives being particularly useful for this purpose. Any other suitable drive may be used, however, for reciprocating the tamping tools.

As is well illustrated in FIG. 3, the tamping tools surround the points of intersection of rail 3 and ties 4 so as to assure solid compaction of the ballast underneath these track support points while avoiding ballast tamping in the center of the ties and/or displacement of ballast towards the shoulders of the bed.

As shown in FIGS. 1 and 3, measuring signal pickup and transmitter 6 is mounted on a vertical rod running on rail 3 for free vertical movement in response to the level of the rail, as is conventional in track leveling reference systems of the illustrated type.

Figure 4:
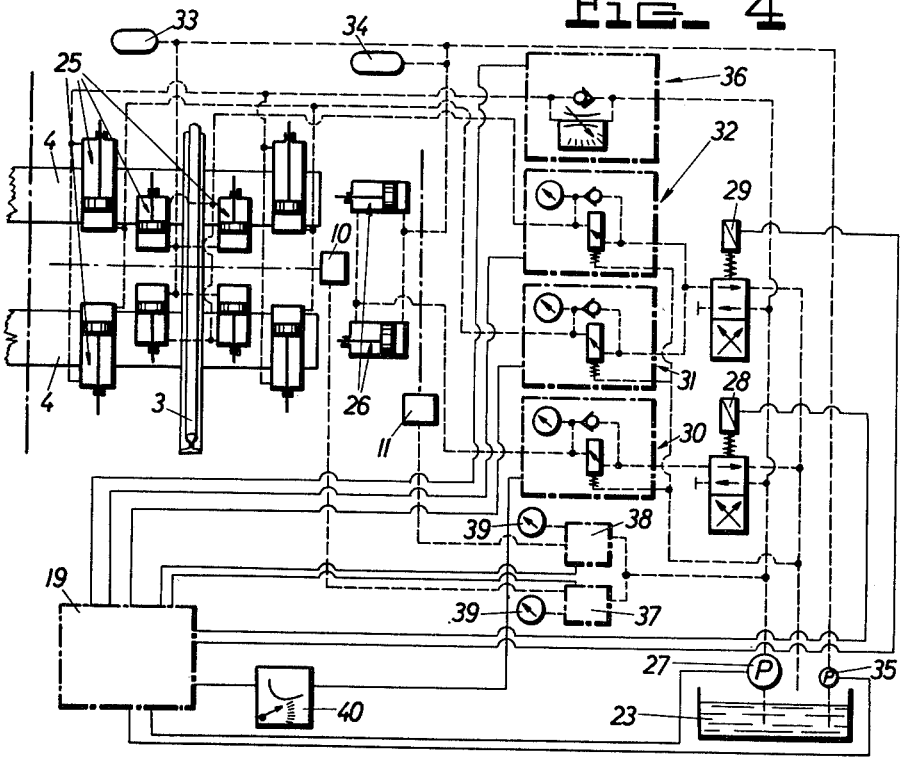
FIG. 4 is a simplified diagram of the control circuit for the operation of the cirb and end tamping tools.

The simplified diagram of FIG. 4, shows the control circuit for hydraulic reciprocating drives 25 and 26 for crib tamping tools 8 and end tamping tools 9. In this diagram, the hydraulic fluid supply conduits are shown in broken lines while the electric circuit is shown in full lines. Constant speed pump 27, which has a relatively high capacity, for instance 200 liters of hydraulic fluid per minute, delivers hydraulic fluid from tank 23 through supply conduits to vibratory drives 10, 11 and reciprocatory drives 25, 26. Solenoid valves 28 and 29 are mounted in a supply conduit coming from tank 23 and may be operated to direct the hydraulic fluid respectively to pressure adjustment device or governor 30 and to pressure adjustment devices or governors 31, 32. Each of the pressure adjustment devices 30, 31, 32 comprises a pressure reducing valve, a pressure gage or manometer, and a check valve. One supply conduit leads from pressure adjustment device 30 to the cylinder chambers of hydraulic motors 26 which face rail 3 for reciprocation of end tamping tools 9. Another hydraulic fluid supply conduit leads from pressure adjustment device 31 to the two outer cylinder chambers of hydraulic motors 25 farthest removed from rail 3. A still further hydraulic fluid supply conduit leads from pressure adjustment device 32 to the two outer cylinder chambers of hydraulic motors 25 closest to rail 3. The two latter hydraulic motors 25 reciprocate the crib tamping tools 8 which are immersed in the crib between the two ties being tamped while the two former hydraulic motors 25 farthest removed from rail 3 reciprocate tamping tools 8 which are immersed in the two cribs bounding the two tamped ties. The two facing cylinder chambers of hydraulic motors 25 closest to the rail are connected to pressure fluid reservoir 33 while the two cylinder chambers of hydraulic motors 26 which are farthest from rail 3 are connected to pressure fluid reservoir 34. The pressure fluid supply from the reservoirs serves to return these tamping tools from their respective operative positions to their rest positions. Since the opening of these tamping tools may be effected at a speed slower than that required for squeezing these tamping tools during the tamping operation, a branch conduit supplies hydraulic fluid from tank 23 to pressure reservoirs 33, 34 by means of a lower capacity pump 35 which, for instance, delivers 60 liters of hydraulic fluid per minute. Opening of the tamping tools actuated by the hydraulic motors farthest from rail 3 is effected by hydraulic fluid supplied to the outer cylinder chambers of the hydraulic motors 25 farthest from rail 3 through a branch conduit leading thereto from tank 23, pump 27 delivering the fluid through pressure reduction device or throttle 36 which is mounted in this branch conduit between pump 27 and motors 25. Through another branch conduit, pump 27 also delivers hydraulic fluid to pressure adjustment devices 37, 38 respectively connected to vibratory drives 10, 11.

Pressure adjustment devices 30, 31, 32 and 37, 38 are arranged to permit a reduction of the throughput as well as the pressure of hydraulic fluid to the hydraulic motors operative to reciprocate and vibrate the tamping tools. Gage 39 for measuring and, preferably, indicating the throughput and pressure is associated with each pressure adjustment deivce. Such gages may be designed to measure the pressure, the pressure differential and/or the fluid throughput, and indicators are connected thereto to enable an operator to read the gaged pressure and/or fluid throughput.

The hydraulic fluid flow and pressure is regulated from central control 19. A separate electric control circuit line connects each pressure adjustment device 30, 31, 32, 37, 38 and pressure throttle 36 to control 19. The gage 39 of each pressure adjustment device transmits a signal corresponding to the gaged pressure and fluid throughputback to the control to facilitate the control of the operation by an operator at control 19. It may be useful for this control operation to provide additional gages in the hydraulic supply system.

The supply of hydraulic fluid to hydraulic motors 25 for squeezing the crib tamping tools 8 is controlled by solenoid valve 29 connected to control device 19 while the supply of hydraulic fluid to hydraulic motors 26 for squeezing the end tamping tools 9 is controlled by solenoid valve 28 also connected to control device 19, timing device 40 being arranged between the solenoid of valve 28 and control device 19 to delay or accelerate the operation. The timing device comprises an adjustment element cooperating with a scale for adjusting the device.

The central control of the reciprocating and vibrating drives makes it possible to adjust the pressures of all tamping tools and the frequency of their vibrations rapidly and in proper cooperative relationship to adapt them to local operating conditions and so as to assure uniform tamping over long track sections, regardless of the extent of leveling required at different points.

Figure 5:
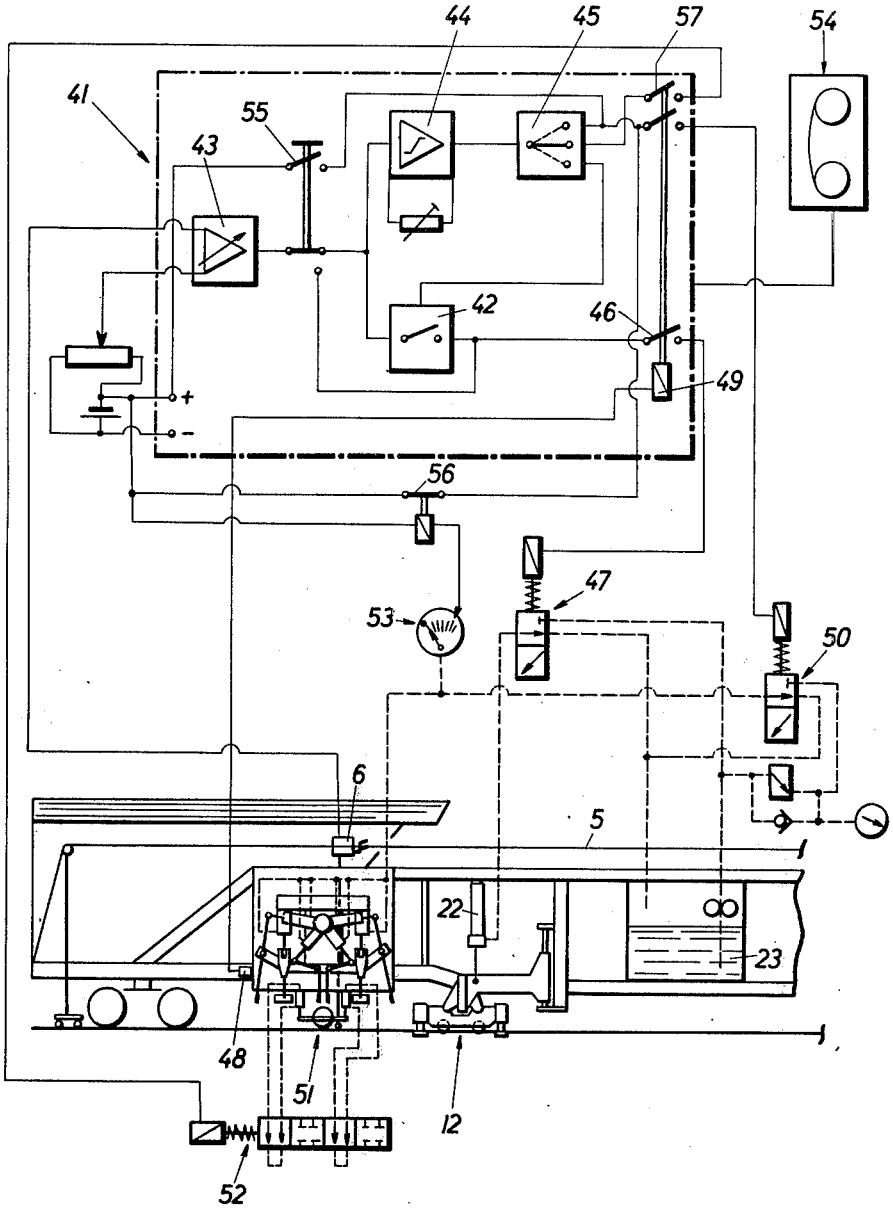
FIG. 5 is a diagram of the control circuit for operating the machine to tamp and level the track.

FIG. 5 schematically shows an embodiment of a control circuit 41 for the operation of crib and end tamping tools 8, 9 and track holding unit 12. As shown in the drawing, the error signal from reference signal pickup and transmitter 6 is transmitted to sum-and-difference amplifier 43 which comprises as adjustable resistance set to indicate the desired value, the error signal being compared with the set value in the amplifier. The comparison signal is transmitted from amplifier 43 to stepping switch 44 whose switching steps are adjustable. Depending on the adjustment of the switch, contact 45 is actuated in response to the comparison signal received, which contact places the drives for reciprocation of the tamping tools and for track holding unit 12 into a state of readiness. When switch 44 moves contact 45 into its lower position, as shown in FIG. 5, which produces a state of readiness for track lifting, switch 42 is operated to transmit the comparison or error signal directly to solenoid valve 47, which preferably is a servo valve. This valve is arranged in the hydraulic supply conduit leading from tank 23 to lifting cylinder 22 and opening thereof permits hydraulic fluid flow to the cylinder for lifting unit 12, and thus the track, in response to the error signal. However, track lifting as well as reciprocation of the tamping tools is effected only when limit switch 48 affixed to the machine frame in the path of the vertical movement of tamping tool assembly 7 is tripped upon lowering of the tamping tool assembly, the limit switch being connected to relay 49 which actuates control switch 46 in the electrical connection between switch 42 and servo valve 47. The relay also actuates control switches 57 for operation of the tamping tools so that, depending on the position of contact 45 controlled by switch 44, servo valve 47 controlling the track lifting or servo valve 50 controlling the tamping tool reciprocation is actuated.

The machine operation is controlled in the following manner:

When the comparison or error signal detected and transmitted by amplifier 43 is below the tolerance, i.e. the switching step, set at switch 44, contact 45 connected to switch 44 is in the illustrated upper position, placing the hydraulic supply to the tamping tool drives into a state of readiness. When the error signal surpasses the set tolerance, switch 44 moves contact 45 from its upper end position to its lower end position to close switch 42 and place the hydraulic supply to lifting unit 12 into a state of readiness. Assuming control switches 46 and 57 to be closed upon tripping of limit switch 48 caused by lowering of the tamping tool assembly, servo valve 47 will be opened and the track will be raised by unit 12 as long as the error signal value exceeds that of the set switching step and until it is equal thereto, after which, i.e. in the period between the set switching step value and the value of the desired level, servo valve 47 is closed and servo valve 50 remains open for further compaction of the ballast by the squeezing tamping tools after track jacking has been terminated. Closing of valve 47 locks unit 12 in position so as to hold the track. Track holding mechanism 51 is mounted in the range of the tamping tool assembly so as to prevent the tamped ballast from raising the track above the desired level determined by the reference system 5. In the illustrated embodiment, track holding mechanism 51 comprises two hydraulic cylinders for vertically moving the mechanism relative to the machine frame. The mechanism further includes means engaging the track rails. A fluid flow blocking device 52 is mounted in the hydraulic supply conduit to the cylinders of track holding mechanism 51, this blocking device being actuated electromagnetically and the solenoid for the actuation of blocking device 52 being connected to contact 45 for operation when the contact has reached the illustrated middle position indicating the desired level of the track, i.e. the track is held by mechanism 51 at the desired level against further upward movement by tamped ballast. This avoids excess lifting of the track beyond the desired level during tamping. When the tamping tool assembly is raised, limit switch 48 will open relay 49, thus opening control switches 57 and blocking device 52.

As indicated by the chain-dotted lines in FIG. 5, the amplifier and switches of the control circuit 41 are mounted on a panel to simplify the operation and possible repairs, the entire panel being replaceable in case of break-downs.

A throw-over switch 55 is also mounted on the panel in the connection between amplifier 43 and switch 44, operation of switch 55 cutting out switch 44 and contact 45 from the control circuit and transmitting the error signal from the amplifier directly to servo valves 47 and 50, causing the track to be lifted solely by unit 12 and not by tamping of the ballast. It is also possible so to set switch 44 that the track will be lifted by unit 12 up to the desired level when the error signal exceeds the switching step and the tamping tools only tamp the ballast while error signals smaller than the switching step set at switch 44 will cause track lifting solely by means of ballast tamping.

A master pressure gage 53, which is preferably associated with a pressure indicator, is mounted in the hydraulic supply conduit for the tamping tool drives so as to make it possible to obtain and control the desired degree of ballast compaction by squeezing of the tools. Master switch 56 in the electrical control circuit is connected to pressure gage 53, a relay for the actuation of the master switch being responsive to a set maximum pressure to open the master switch and thus to interrupt a direct circuit controlling hydraulic fluid supply to the tamping tool drives. This direct control circuit is in shunt with switch 44 and contact 45 so that ballast tamping is continued until the set maximum degree of ballast compaction against the counter pressure of track holding device 51 has been reached after the track has been lifted by jack 24. In its simplest, illustrated form, the master switch is constituted by an adjustable contact associated with the indicator of a contact manometer.

After tamping has been completed, the tamping tool assembly is raised and opened limit switch 48 will actuate relay 49 so as to interrupt hydraulic fluid flow to the tamping tool drives and holding units 12 and 51. The mobile machine is then advanced by a distance of two ties to start the next tamping and leveling cycle.

Fully automatic operation of control 41 may be achieved by connecting the control circuit, and also control 19, if desired, to a suitable programmer 54 operating on an analog or digital computer basis, thus relieving the operator of any control function and enabling him to concentrate on adjusting the operating results. Such a programmer will automatically control the degree of tamping, the tamping tool reciprocating times and pressures as well as the frequency and/or amplitude of the tamping tool vibrations in response to data transmitted to the programmer by the pressure adjustment devices and corresponding to the condition of the ballast. Such data may be stored, for instance, on perforated bands or cards, or magnetic tapes.

The operation of control 41 may be programmed in a variety of ways but always so that jack 22 ceases operation just before tamping has been completed, the delay between terminating the track jacking and tamping being of the order of some tenths of seconds to a few seconds, i.e. quite brief. While in the above-described embodiment of FIG. 1, the track is jacked to the desired level and held at that level while tamping is continued for the indicated brief period for further compaction of the ballast, the control of FIG. 5 is preferably programmed to terminate track jacking before the track has been raised to the desired level and the final track raising stroke against the limit determined by holding mechanism 51 is effected solely by the continuing tamping. In this manner, track lifting unit 12 does not carry the track weight during those final tenths of seconds or seconds of surfacing but this weight presses against the ballast during the final tamping. This downward pressure aids in more rapidly and effectively increasing the ballast compaction, and thus improves the quality of the tamped track. This effect may be further increased, if desired, by continuing tamping even after the track has been pressed upwards against holding mechanism 51 (as in the embodiment of FIG. 1).

Depending on track conditions, tamping is continued briefly after termination of jacking either until the track level determined by holding mechanism 51 has been reached or even for moments after it has been reached, the interval between termination of jacking and tamping being varied according to conditions. As is known, it may be desired in certain instances, for instance at rail joints, to set track holding mechanism 51 slightly above the final desired level for the track to give the track a chance to settle to this level under train traffic immediately subsequent to the surfacing operation.

A track surfaced with a tamping and leveling machine of the above described structure will be much more uniformly tamped than has been possible with conventional machines and will thus assure greater stability of the graded track. This will make it possible to increase the length of the time intervals between surfacing operation so as to obtain considerable economy in the maintenance of tracks of a high quality.

What is claimed is:

1. Apparatus for leveling a track consisting of rails mounted on ties and tamping ballast thereunder, comprising the combination of (1) a reference system in relation to which the track is leveled, (2) jacking means for lifting the track, (3) tamping means for tamping the ballast by vibratory pressure, (4) control means for operating the jacking and tamping means, the control means including (a) a control for simultaneously jacking and tamping the track, and (b) a control for terminating track jacking before tamping has been completed.

(5) means in the region of the tamping means for holding the track in a position under the control of the reference system, and (6) means for locking the holding means in said position under the control of the reference system.

2. The apparatus of claim 1, wherein the track holding means is positioned above the point of tamping in the region of the tamping means.

3. The apparatus of claim 1, wherein the tamping means comprises a vertically movable tamping tool assembly including a pair of opposed vibratory tamping tools arranged for immersion in the cribs adjacent a tie and for reciprocation in the direction of track elongation, with the tie positioned between the opposed tools, an additional vibratory tamping tool arranged for immersion in the ballast adjacent the end of the tie and for reciprocation in a direction transverse of the direction of track elongation, and drive means for the reciprocation and for the vibration of the tamping tools, the control means operating the drive means.

4. The apparatus of claim 3, further comprising a control for regulating the degree of ballast compaction, the control comprising regulating means for the drive means, the regulating means comprising separate governors associated respectively with the drive means for the opposed tamping tools and the drive means for the additional tamping tools.

* * * * *